US007719204B1

(12) United States Patent
Poehlman

(10) Patent No.: US 7,719,204 B1
(45) Date of Patent: May 18, 2010

(54) METHOD FOR CONTROLLING STRIATIONS IN A LAMP POWERED BY AN ELECTRONIC BALLAST

(75) Inventor: Thomas M. Poehlman, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 143 days.

(21) Appl. No.: 12/140,056

(22) Filed: Jun. 16, 2008

Related U.S. Application Data

(62) Division of application No. 11/003,539, filed on Dec. 3, 2004, now abandoned.

(60) Provisional application No. 60/540,187, filed on Jan. 29, 2004.

(51) Int. Cl.
*H05B 37/02* (2006.01)

(52) U.S. Cl. ..... 315/291; 315/209 R; 315/219; 315/246

(58) Field of Classification Search ..... 315/291, 315/224, 225, 246, 209 R, 219, DIG. 5
See application file for complete search history.

(56) References Cited

U.S. PATENT DOCUMENTS

| | | | | |
|---|---|---|---|---|
| 4,682,083 | A | 7/1987 | Alley | |
| 5,001,386 | A | 3/1991 | Sullivan et al. | |
| 5,023,510 | A | 6/1991 | Groothoff | |
| 5,034,660 | A | 7/1991 | Sairanen | |
| 5,041,763 | A | 8/1991 | Sullivan et al. | |
| 5,055,742 | A | 10/1991 | Jurell et al. | |
| 5,192,896 | A | 3/1993 | Qin | |
| 5,369,339 | A | 11/1994 | Reijnaerts | |
| 5,583,402 | A | 12/1996 | Moisin et al. | |
| 5,612,597 | A | 3/1997 | Wood | |
| 5,701,059 | A | 12/1997 | Steigerwald et al. | |
| 5,760,541 | A | 6/1998 | Stavely et al. | |
| 5,831,395 | A | 11/1998 | Mortimer et al. | |
| 6,069,453 | A | 5/2000 | Arts et al. | |
| 6,121,732 | A * | 9/2000 | Parker et al. | 315/224 |
| 6,459,213 | B1 | 10/2002 | Nilssen | |
| 6,465,972 | B1 | 10/2002 | Kachmarik et al. | |
| 6,836,077 | B2 * | 12/2004 | Nerone | 315/209 R |

FOREIGN PATENT DOCUMENTS

| | | |
|---|---|---|
| DE | 3339464 | 5/1985 |
| EP | 0127101 | 12/1984 |
| EP | 0435231 | 7/1991 |
| EP | 0657091 | 6/1995 |
| JP | 04233199 | 8/1992 |
| JP | 8180984 | 7/1996 |
| WO | WO9724017 | 7/1997 |

* cited by examiner

*Primary Examiner*—Douglas W Owens
*Assistant Examiner*—Ephrem Alemu
(74) *Attorney, Agent, or Firm*—Waddey & Patterson; Mark J. Patterson

(57) ABSTRACT

A method for controlling striations in a lamp powered by an electronic ballast includes the steps of generating an asymmetric lamp current using an unbalanced circuit component in the electronic ballast and supplying that current to the lamp. The unbalanced circuit component may be an unbalanced output transformer or an unbalanced DC choke. The output transformer is unbalanced by offsetting the number of turns on each side of the tap on the primary winding of the transformer. In a similar manner, the DC choke is unbalanced by offsetting the number of turns in each winding of the choke.

8 Claims, 8 Drawing Sheets

METHOD FOR CONTROLLING STRIATIONS IN A LAMP POWERED BY AN ELECTRONIC BALLAST

CROSS-REFERENCES TO RELATED APPLICATIONS

This application is a divisional application of co-pending U.S. patent application Ser. No. 11/003,539 filed Dec. 3, 2004, entitled "Method of Controlling Striations in a Lamp Powered by an Electronic Ballast" which claims the benefit of U.S. Provisional Application No. 60/540,187, filed Jan. 29, 2004, entitled "Methods of Striation Control for Current Fed, Parallel Resonant Inverters".

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

BACKGROUND OF THE INVENTION

The present invention relates generally to controlling striations in lamps powered by electronic ballasts.

More particularly, this invention pertains to methods for controlling lamp striations by supplying the lamp with asymmetric lamp currents.

Methods of controlling lamp striations are known in the art. For example, U.S. Pat. Nos. 5,041,763 and 5,192,896 teach the use of methods that include the step of supplying DC or low frequency AC current to a lamp in order to control striations. The primary disadvantage of these methods is that they require electronic ballasts that include additional components for generating the DC or low frequency AC currents and these additional components increase the costs and losses associated with the electronic ballasts.

U.S. Pat. No. 6,465,972 also teaches a method of controlling striations. In this patent, striations are controlled by varying the amplitude of the current that is supplied to the lamp using an amplitude modulation circuit. This method suffers from the same disadvantage as the method taught by the '763 patent. That is, it requires an electronic ballast that includes additional components and those components increase the costs and losses associated with that ballast.

U.S. Pat. No. 6,069,453 teaches a method of controlling striations by supplying a lamp with a current that includes a DC component, a high frequency AC component, and a low frequency component. In addition, the amplitude of the high frequency AC component must be at least 500 times higher than the amplitude of the low frequency component. As was the case with the '763, '896, and '972 patents, this method requires the use of an electronic ballast having additional components that increase the costs and losses associated with the ballast.

U.S. Pat. Nos. 5,701,059, 5,369,339, and 5,001,386 all teach methods of controlling striations in lamps. All of these methods, however, require the use of additional components that are not required to perform the functions most commonly performed by an electronic ballast. For example, the method taught by the '059 patent requires the use of an impedance that is connected in parallel with a lamp. The method taught by the '339 patent requires a DC device that can supply DC current to a lamp. And, the method taught by the '386 patent requires a back end rectifier that is used to supply a DC current to a lamp. The requirement of these additional components increases the cost and losses associated with the electronic ballasts required to implement these methods.

What is needed, then, is a method of controlling striations in a lamp that does not require the use of an electronic ballast that includes additional components that increase the costs and losses associated with that ballast.

BRIEF SUMMARY OF THE INVENTION

One of the objects of the present invention is to provide a method of controlling striations in a lamp powered by an electronic ballast that does not require the use of additional components specifically included in the ballast for that purpose. Or, to put it another way, one of the objects of the present invention is to provide a method of controlling striations in a lamp using a conventional electronic ballast that has been modified in some way that prevents striations from occurring in a lamp powered by that ballast.

The applicant of the present application has determined that this object can be achieved by forcing the inverter transistors in a conventional electronic ballast to have different conduction times. The difference in conduction time causes an asymmetric voltage to be generated by the electronic ballast and this voltage causes an asymmetric current to flow in a lamp connected to the ballast. The asymmetric current, in turn, causes striations in the lamp to move at a rate that makes them invisible to the human eye. Thus, by varying the conduction times, one can control the striations in the lamp.

The conduction time is essentially the "on-time" of the transistor, i.e., the time that current is flowing through the transistor. The difference in conduction time does not need to be significant; differences ranging from fractions of a microsecond to one and a half microseconds have been found to provide acceptable results.

The applicant has determined that the inverter transistors can be forced to have different conduction times by redesigning some of the components included in a conventional electronic ballast. For example, in an electronic ballast that includes a self-oscillating, current fed, parallel resonant push-pull inverter, the conduction times of the inverter transistors can be modified by offsetting the center-tap on the output transformer included in that type of inverter by a few turns. As was the case with the variation in the conduction times, the amount of offset does not need to be significant. An offset of no more than five percent of the total primary turns has been found to cause the conduction times of the inverter transistors to vary the appropriate amount. In an electronic ballast that includes a self-oscillating, current fed, parallel resonant half-bridge inverter, the same effect can be achieved by offsetting the number of turns in one winding of the DC choke that is included in this type of inverter by approximately five percent. Of course, an offset greater than five percent may be used in either case as well By redesigning the components of a conventional electronic ballast in this manner, the striations in a lamp powered by the ballast can be controlled. Importantly, it should be noted that this control is achieved without adding any additional components to the electronic ballast. As a result, the present invention does not suffer from the increased costs and losses associated with prior art methods that require the use of additional components specifically designed to control striations.

The applicant has found that the present invention is particularly useful when supplying power to new fluorescent lamps that include an increased amount of Krypton in the fill gas. While the increased amount of Krypton causes these lamps to have reduced arc voltages, it also increases the probability that visible striations will be produced by the lamp. By using electronic ballasts that have been modified according to the present invention, these visible striations are eliminated.

In summary, then, and according to one aspect, the present invention includes a method of controlling striations in a lamp powered by an electronic ballast that includes the step of generating an asymmetric lamp current using an unbalanced circuit component in the electronic ballast and supplying that current to the lamp. According to another aspect, the present invention includes an electronic ballast having an unbalanced circuit component that causes the ballast to supply asymmetric lamp current to a lamp when the lamp is connected to the ballast. In one embodiment, the unbalanced circuit component is an unbalanced output transformer, while in another embodiment the unbalanced circuit component is an unbalanced DC choke. According to a third aspect, the present invention includes a method of modifying an electronic ballast so that it produces an asymmetric lamp current without any additional components specifically included for that purpose.

DETAILED DESCRIPTION OF THE INVENTION

In the following discussion, the present invention is discussed with reference to what is commonly referred to as a current-fed, parallel resonant push pull ballast and a current-fed, parallel resonant half bridge ballast. It should be noted that the various aspects of the present invention are not limited to these particular types of ballasts and may be applied to other ballasts as well.

Figure 1:
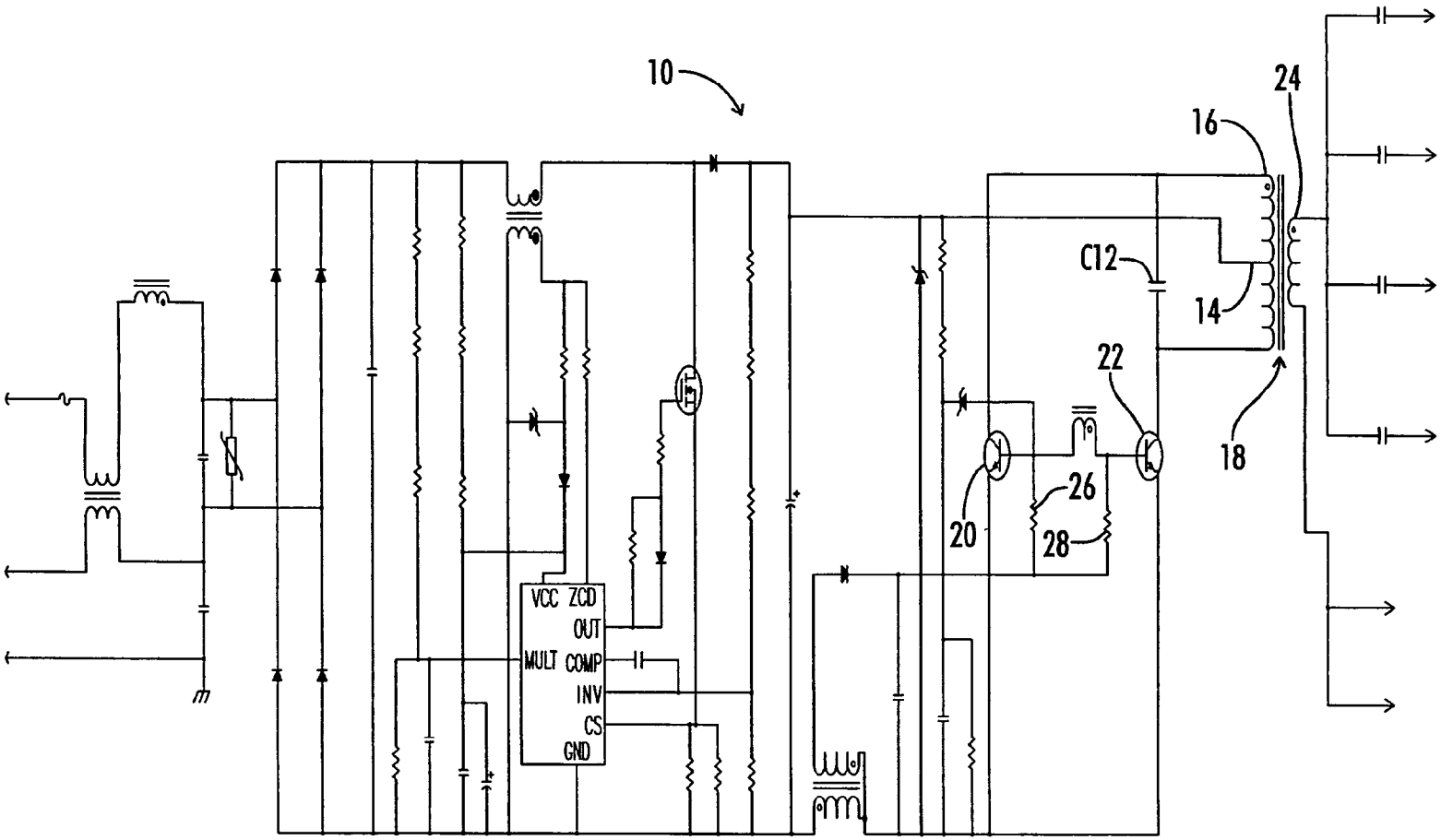
FIG. 1 (PRIOR ART)
FIG. 1 is a schematic drawing of a conventional parallel resonant push pull electronic ballast.
Figure 2:
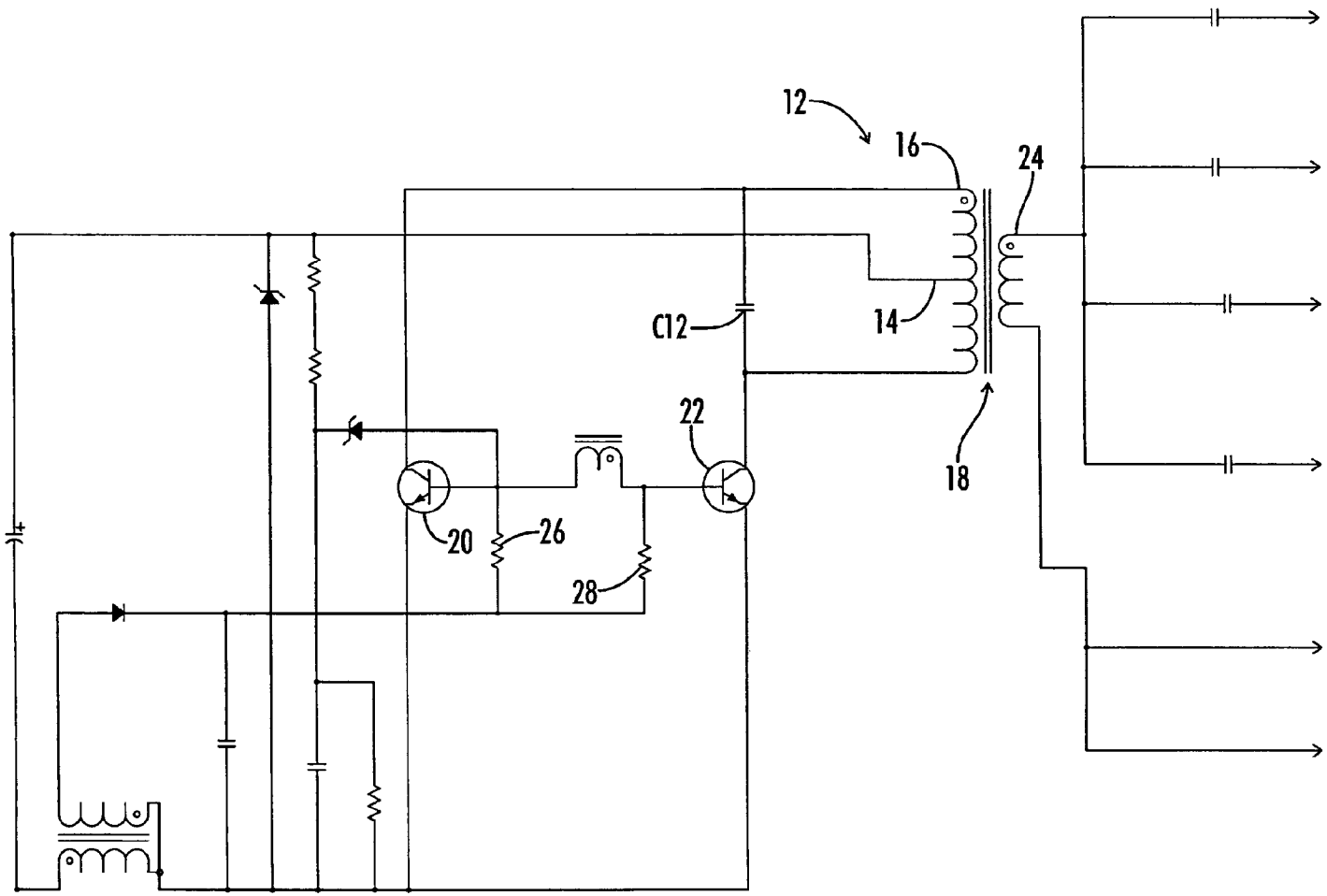
FIG. 2 (PRIOR ART)
FIG. 2 is an enlarged schematic drawing of the push pull inverter shown in FIG. 1.

FIGS. 1-2 are schematic drawings of a conventional parallel resonant push pull electronic ballast circuit 10. FIG. 1 is a drawing of the entire ballast 10 and FIG. 2 is an enlarged view of a portion of the ballast 10 including a push pull inverter circuit 12. The operation of this type of ballast is well known in the art and will not be discussed in detail. In general, however, the ballast 10 is operable to receive a low frequency, 60 Hz, voltage input, convert that input into a substantially constant DC voltage, and then convert that DC voltage into a high frequency (typically greater than 20 kHz, but can be lower if desired) sinusoidal output voltage that can be applied to a lamp. The specific operational features of this ballast that are relevant to the present invention are discussed below.

Figure 3:
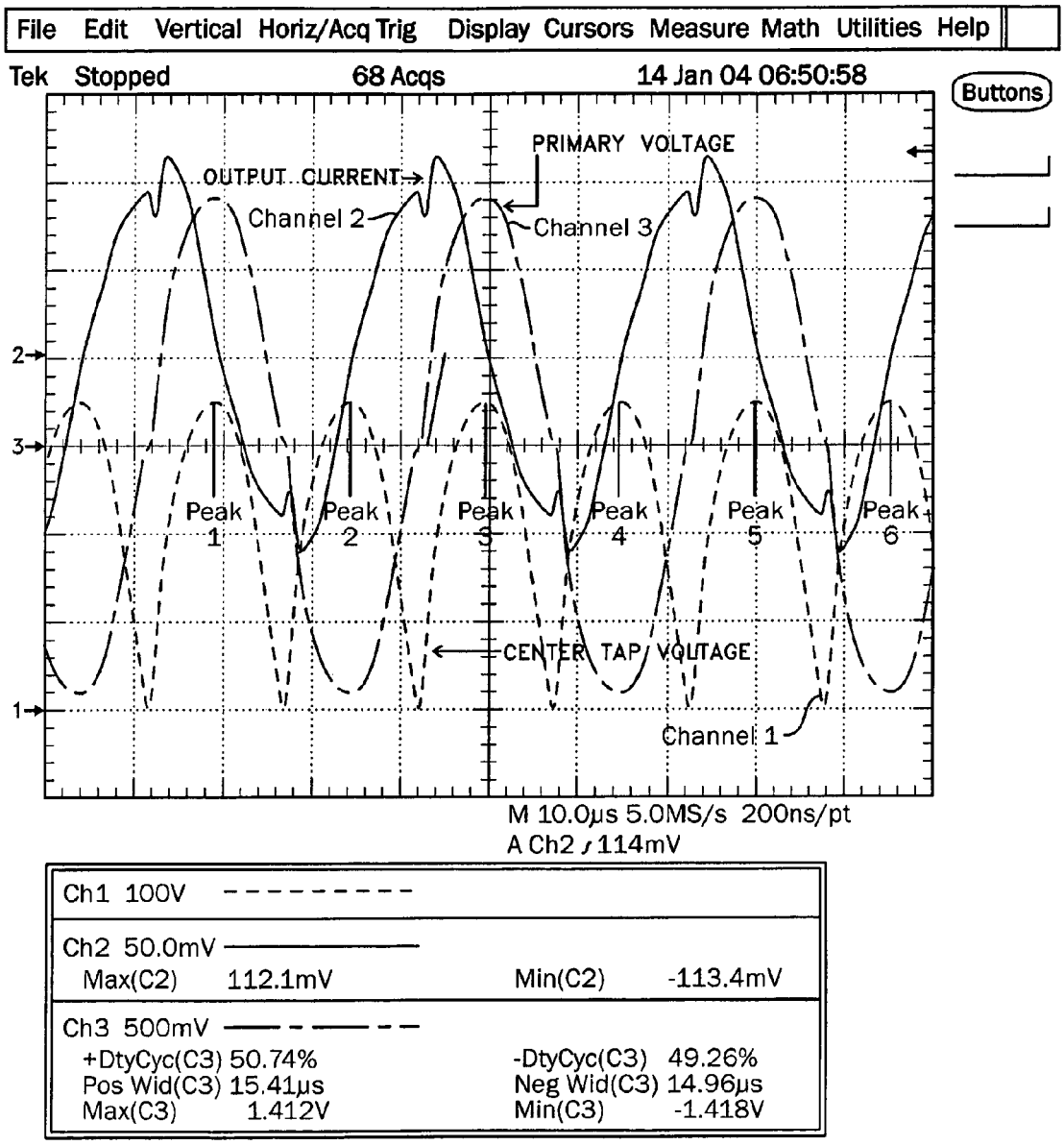
FIG. 3 (PRIOR ART)
FIG. 3 is an oscilloscope printout showing the center tap voltage, the primary winding voltage, and the output current generated by the electronic ballast shown in FIG. 1.

FIG. 3 is an oscilloscope printout showing various waveforms that are generated by the conventional electronic ballast 10 shown in FIG. 1. The waveform on Channel 1 is the voltage that appears at the center tap 14 of the primary winding 16 on the output transformer 18. The waveform on Channel 2 is the output current that is supplied to a lamp by this ballast and the waveform on Channel 3 is the voltage across the primary winding 16 on the output transformer 18 of this ballast 10.

A review of this figure clearly shows that the voltage peaks of the center tap voltage waveform, Channel 1, are very similar. Peak 1 is approximately 350 volts and Peak 2 is approximately 350 volts as well. Peaks 1, 3, and 5 represent the voltage across one half of the primary winding of the output transformer and Peaks 2, 4, and 6 represent the voltage that appears across the other half of the primary winding.

In addition, this figure indicates that the inverter transistors, 20 and 22, are both on, or conducting current, for approximately the same amount of time, i.e., both transistors have approximately the same conduction times. This is shown by the duty cycle values included in the figure and waveform on Channel 3. The positive duty cycle is approximately 50.74%, while the negative duty cycle is approximately 49.26%. In other words, both transistors have approximately a 50% duty cycle.

The resulting output current, Channel 2, is very symmetrical. This is caused by the approximately equal conduction times of the transistors, 20 and 22.

Figure 4:
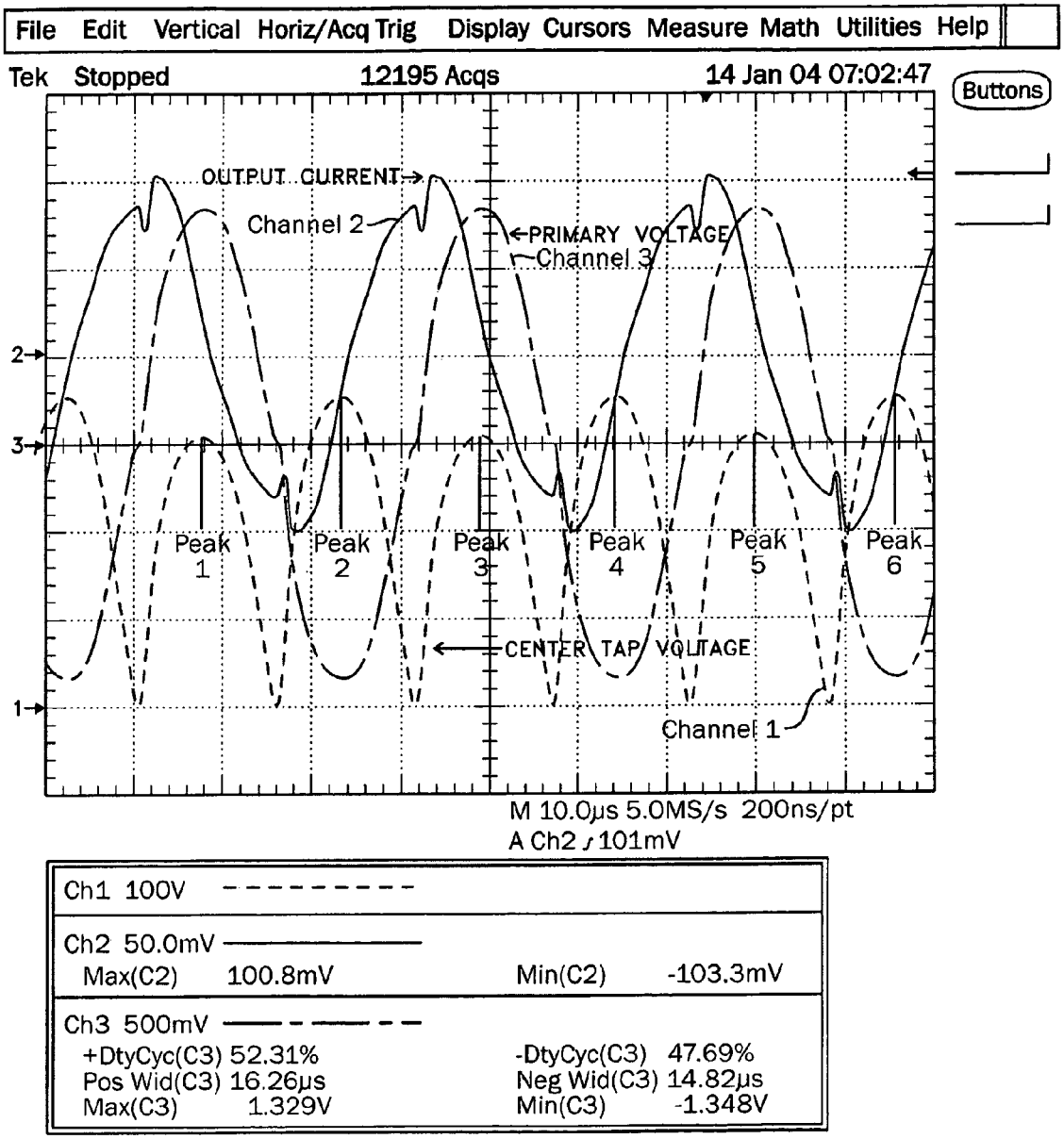
FIG. 4 is an oscilloscope printout showing the center tap voltage, the primary winding voltage, and the output current generated by the electronic ballast shown in FIG. 1 after it has been modified according to the teachings of the present invention.

FIG. 4 is an oscilloscope printout showing various waveforms that are generated by the conventional electronic ballast 10 shown in FIG. 1 after it have been modified in the manner taught by the present invention. As was the case with FIG. 3, the waveform on Channel 1 is the voltage that appears at the center tap 14 of the primary winding 16 on the output transformer 18, the waveform on Channel 2 is the output current that is supplied to a lamp by this ballast, and the waveform on Channel 3 is the voltage across the primary winding 16 on the output transformer 18 of this ballast 10.

The waveforms shown in FIG. 4, however, are slightly different from the waveforms shown in FIG. 3. For example, the waveform showing the voltage at the center tap 14 of the primary winding 16 of the output transformer 18, Channel 1, now includes peaks that are unequal. Peak 1 is now approximately 300 volts and Peak 2 is now approximately 350 volts; a difference of approximately 50 volts. The difference in voltage was achieved by constructing the output transformer 18 so that one half of the primary winding 16 has 54 turns and the second half has 58 turns. The difference in the number of turns causes a different voltage to appear across each half of the primary winding 16. In alternative embodiments, the number of turns in each half of the primary winding 16 may be different.

In addition, the conduction times of the inverter transistors, 20 and 22, as shown by the waveform on Channel 3, are now unequal. The positive duty cycle is now 52.32% and the negative duty cycle is now 47.69%. In other words, one transistor is now on for approximately 52% of the time and the other transistor is on for approximately 48% of the time.

The inverter transistors, 20 and 22, are on for different periods of time because the resonant tank, which includes the output transformer 18 and the capacitor C12, tries to keep the volt-second product of each half of the primary winding 16 of the transformer 18 equal. In other words, the resonant tank tries to balance the energy in the primary winding 16 of the output transformer 18. The circuit accomplishes this by causing the transistors, 20 and 22, to conduct for different periods of time.

Importantly, the output current waveform shown on Channel 2 is now asymmetric. As shown in FIG. 4, the peak value of the positive half of the current waveform is approximately 100.8 mV (with the instrumentation used 1 mV corresponds to 10 mA) and the negative half is approximately −103.3 mV. The asymmetry in the output current is caused by the fact that different voltages appear across each half of the primary winding 16 of the output transformer 18. This asymmetric voltage is coupled to the secondary 24 of the output transformer 18 and causes the output current to be asymmetrical as well.

When this type of asymmetric output current is supplied to a lamp, and, in particular, a low wattage, high Krypton, T8, fluorescent lamp, it causes the striations in that lamp to be invisible to the human eye.

In summary, then, by offsetting the number of turns in each half of the primary winding 16 of the output transformer 18, the peaks of the haversine voltages measured from the center tap 14 of the transformer 18 to the emitters of the inverter transistors, 20 and 22, are forced to different levels. This, in turn, forces the inverter transistors, 20 and 22, to have different conduction (on) times in order to keep balanced the volt-second product of the resonant tank components, transformer 18 and C12. The result is an asymmetric output lamp current that can be used to control striations in a lamp.

In some applications it may be necessary to adjust the turn-off times of the inverter transistors, 20 and 22, so that they are approximately equal. In the circuit shown in FIG. 2, the turn-off times are not equal, and, in some applications, this may cause the lamp current crest factor to increase to an undesirably high level. In such applications, the lamp current crest factor can be decreased by adjusting the base drive circuit for the inverter transistors so that the turn-off times are approximately equal. This, in turn, can be accomplished by simply adjusting the resistance values for the base resisters, 26 and 28, shown in FIG. 2.

Figure 5:
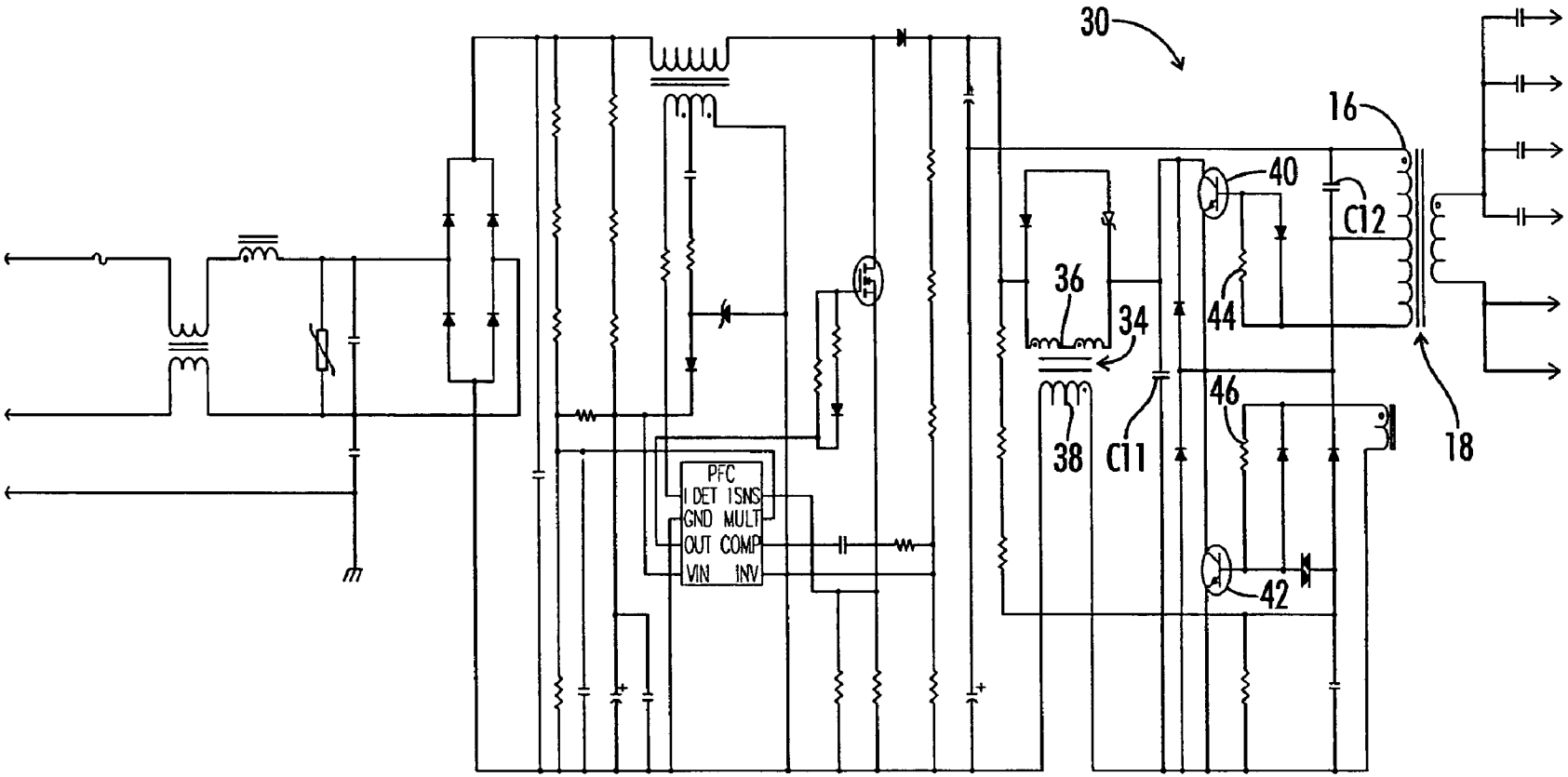
FIG. 5 (PRIOR ART)
FIG. 5 is a schematic drawing of a conventional parallel resonant half bridge electronic ballast.
Figure 6:
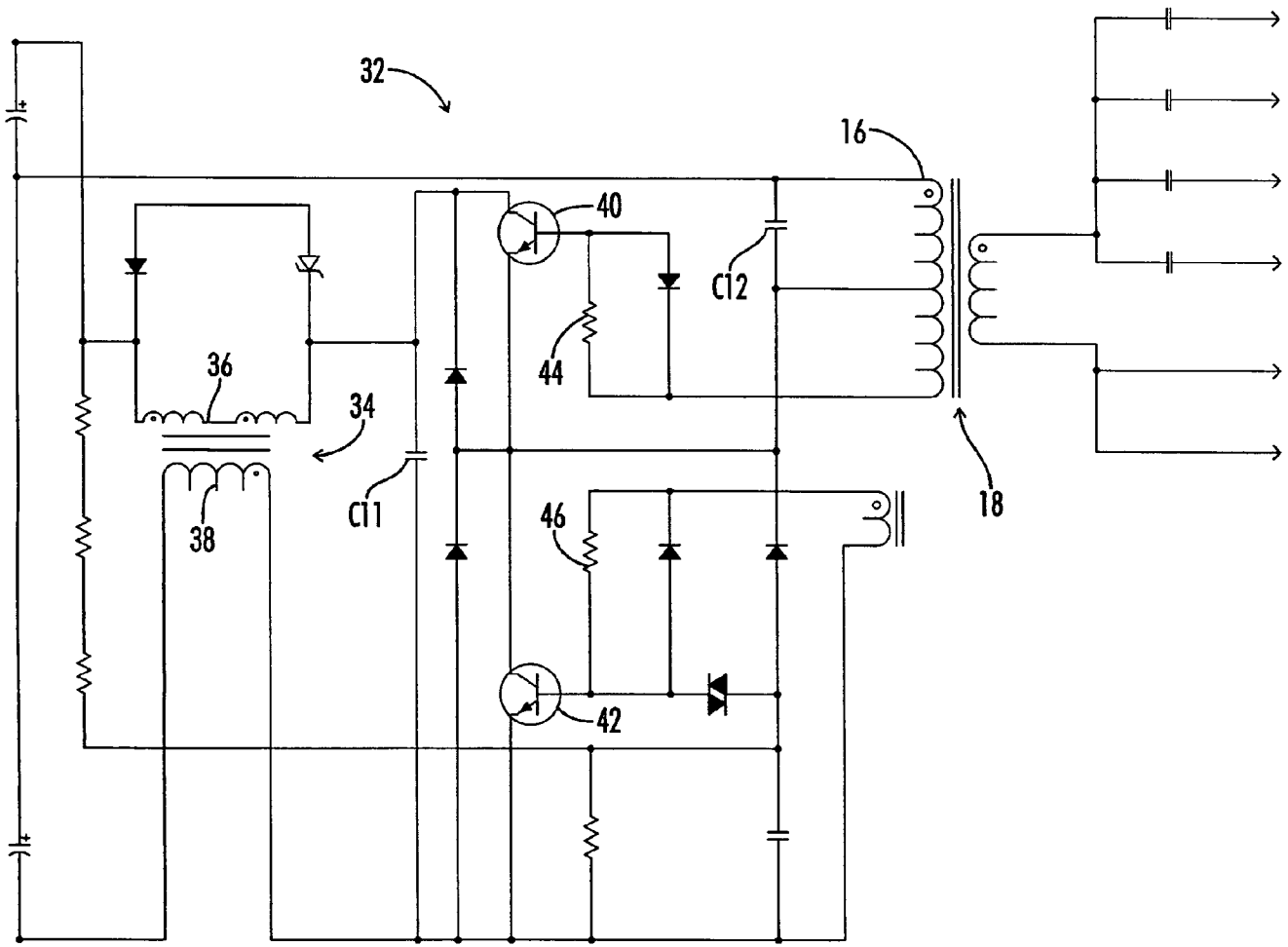
FIG. 6 (PRIOR ART)
FIG. 6 is an enlarged schematic drawing of the half bridge inverter shown in FIG. 5.

Turning now to FIGS. 5-6, the present invention is discussed in connection with a parallel resonant half bridge electronic ballast circuit 30. FIG. 5 is a schematic showing the entire ballast circuit 30 and FIG. 6 is an enlarged schematic showing the half bridge inverter circuit portion 32 of the ballast circuit 30 shown in FIG. 5. Half bridge inverters and electronic ballasts including these types of inverters are well known in the art. As a result, a detailed discussion of their operation is not included. A discussion of the operational features that are necessary to understand the present invention, however, is included below.

As shown in FIGS. 5-6, the half bridge electronic ballast circuit 30 does not include a center tap connection on the primary winding 16 of the output transformer 18 as shown in FIGS. 1-2. As a result, the primary winding cannot be offset in order to generate an asymmetric output lamp current. This circuit, however, does include a DC choke 34 and that circuit element is used instead.

By offsetting the number of turns in each winding, 36 and 38, of the DC choke 34, the peaks of the haversine voltages on complimentary inverter transistors, 40 and 42, are forced to different levels. This, in turn, forces the inverter transistors, 40 and 42, to have different conduction (on) times in order to keep balanced the volt-second product of the resonant tank components, transformer 18, C11, and C12. The result is an asymmetric output lamp current that can be used to control striations in a lamp. As indicated above with regard to the push-pull circuit shown in FIG. 2, forcing the inverter transistors to have different conduction times may cause the lamp current crest factor to increase to unacceptably high levels. If this is the case, the base drive circuit for the inverter transistors can be adjusted so that the turn off times for these transistors is approximately equal. The turn-off times can be adjusted by simply adjusting the resistance values of the base drive resistors, 44 and 46, shown in FIG. 5.

Figure 7:
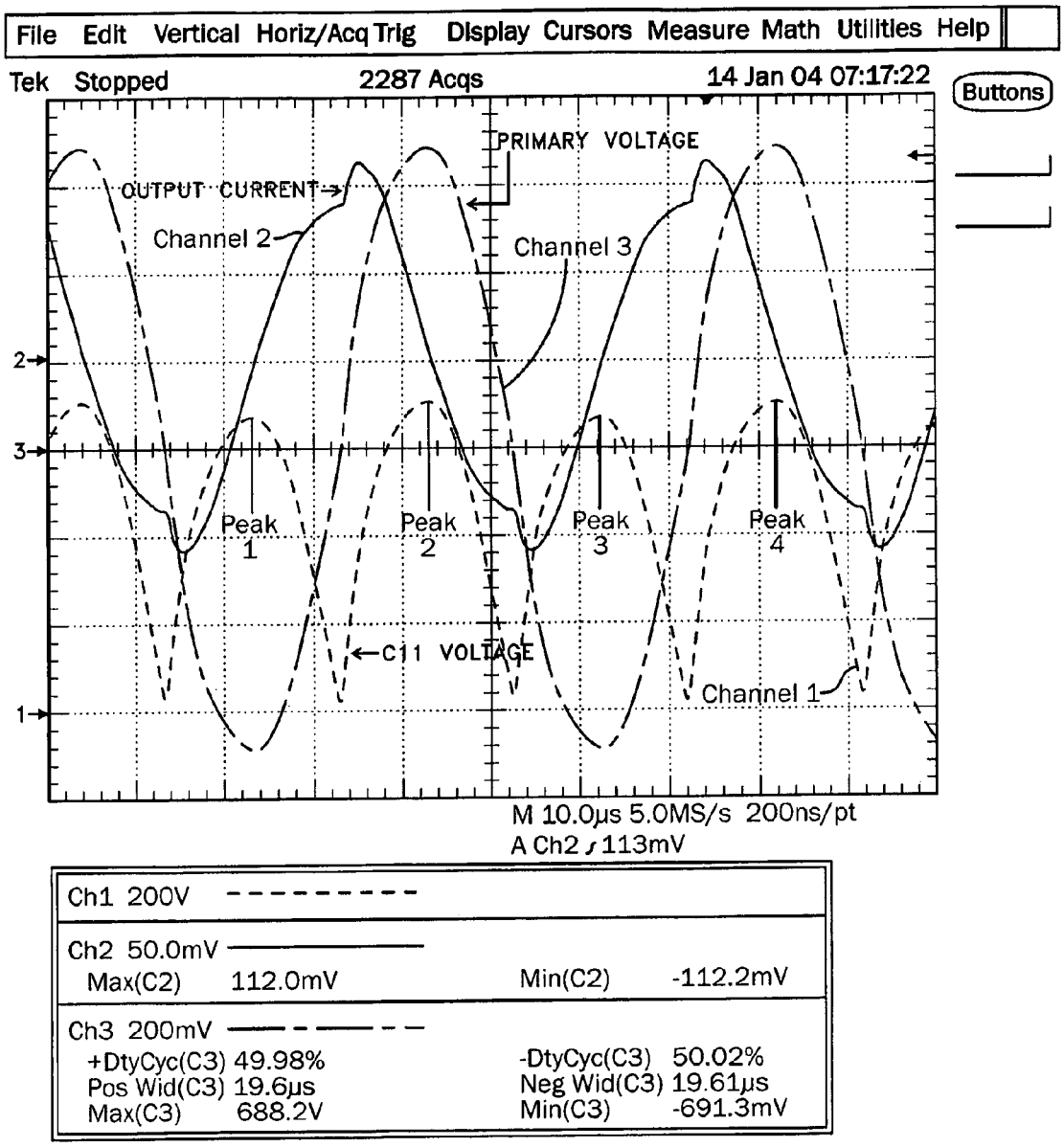
FIG. 7 (PRIOR ART)
FIG. 7 is an oscilloscope printout showing the voltage across C11 in FIG. 6, the primary winding voltage, and the output current generated by the electronic ballast shown in FIG. 5.

FIG. 7 is an oscilloscope printout showing various waveforms that are generated by the conventional half bridge electronic ballast circuit 30 shown in FIG. 5. The waveform on Channel 1 is the voltage that appears capacitor C11. The waveform on Channel 2 is the output lamp current that is supplied to a lamp by this ballast and the waveform on Channel 3 is the voltage across the primary winding 16 on the output transformer 18 of this ballast. In this prior art half bridge ballast 30, the DC choke windings, 36 and 38, are very well balanced and the inverter transistors, 40 and 42, have very little voltage, or conduction time, offset. In addition, the resulting output lamp current, Channel 2, is very symmetrical.

Figure 8:
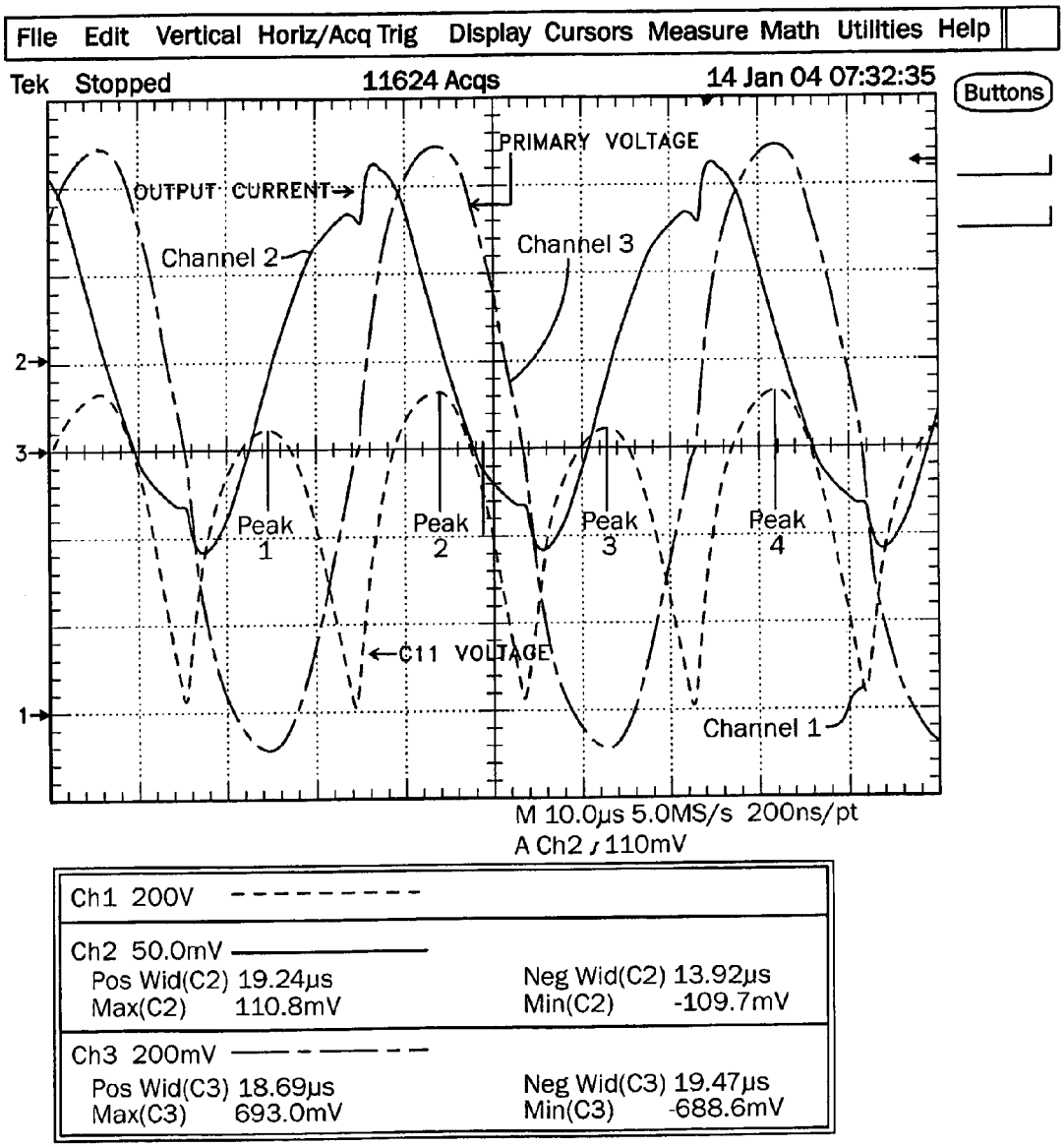
FIG. 8 is an oscilloscope printout showing the voltage across C11 in FIG. 6, the primary winding voltage, and the output current generated by the electronic ballast shown in FIG. 5 after it has been modified according to the teachings of the present invention.

FIG. 8 is an oscilloscope printout showing various waveforms that are generated by the conventional electronic ballast 30 shown in FIG. 5 after it have been modified in the manner taught by the present invention. As was the case with FIG. 7, the waveform on Channel 1 is the voltage across capacitor C11, the waveform on Channel 2 is the output lamp current, and the waveform on Channel 3 is the voltage across the primary winding 16 on the output transformer 18 of the ballast. It should be noted that the voltage on C11 is analogous to the center tap voltage in the push pull inverter and can be used to display the effects of the DC choke offset.

The waveforms shown in FIG. 8 are different from the waveforms shown in FIG. 7. The waveform showing the voltage on C11, Channel 1, now includes peaks that are unequal. Peak 1 is now approximately 640 volts and Peak 2 is now approximately 720 volts; a difference of approximately 80 volts. The difference in voltage is achieved by constructing the DC choke 34 so that one winding has 108 turns and the other winding has 102 turns. The difference in the number of turns causes a different voltage to appear across each winding.

In contrast to FIG. 7, the voltage across the primary winding 16 of the output transformer 18, Channel 3, is now asymmetric in time and magnitude. The waveform is positive for approximately 18.69 microseconds and negative for approximately 19.47 microseconds. In addition, the peak of the positive portion of the waveform is approximately 693 mV (with the instrumentation used this is actually 346.5 volts) and the peak of the negative portion is approximately −688.6 mV (with the instrumentation used this is actually −344.15 volts). As was the case with the push pull ballast discussed previously, this asymmetric voltage is coupled to the secondary winding 24 of the output transformer 18 and is used to generate an asymmetric lamp current, Channel 2. The asymmetry can be seen in the positive and negative "halves" of the waveform shown on Channel 2.

As discussed previously, one of the primary benefits of the present invention is that it can be implemented at a very low cost. No additional circuitry is required to produce the desired asymmetric current waveform. Striations are not visible when low wattage, high Krypton, T8 lamps are used with electronic ballasts that include offset transformers or DC chokes. The resulting difference in conduction time with the method of the present invention may be fractions of a microsecond to one and a half microseconds. Thus, very little asymmetry is needed to mask the visible striations in a lamp using this method.

In alternative embodiments, additional components can be added to slow the switch-off time of one of the inverter transistors. For example, a capacitor may be included in the base drive. Alternatively, additional components, such as a Baker clamp, can be added to decrease the switch-off time of one of the inverter transistors. While these methods can reduce visible striations, they may increase the lamp current crest factor to unacceptable levels. And, of course, these alternatives require some additional components and are not as desirable for this reason.

In other alternative embodiments, the inverter transistors can be forced to have different conduction times by operating the transistors at different switching frequencies.

Thus, although there have been described particular embodiments of the present invention of a new and useful Method For Controlling Striations In A Lamp Powered By An Electronic Ballast, it is not intended that such references be construed as limitations upon the scope of this invention except as set forth in the following claims.

What is claimed is:

1. A method of controlling striations in a lamp powered by an electronic ballast, the electronic ballast including an inverter having at least two inverter switching devices, comprising the steps of:

generating an asymmetric lamp current using an unbalanced circuit component included in the inverter, the unbalanced circuit component includes a DC choke having first and second windings; and supplying an asymmetric lamp current to the lamp by generating unequal voltages on the first and second windings of the DC choke.

2. The method of claim 1, wherein the step of generating the asymmetric lamp current using the unbalanced circuit component includes the step of causing the inverter transistors to have unequal duty cycles.

3. The method of claim 1, wherein the step of generating the asymmetric lamp current using the unbalanced circuit component includes the step of operating the inverter transistors at different operating frequencies.

4. An electronic ballast, comprising:

an unbalanced circuit component that causes the electronic ballast to generate an asymmetric lamp current, wherein the unbalanced circuit component includes an unbalanced DC choke.

5. The ballast of claim 4, wherein:

the unbalanced DC choke includes first and second windings; and the first and second windings have an unequal number of turns.

6. A method of modifying an electronic ballast so that it produces an asymmetric lamp current, comprising the step of:

replacing a DC choke included in the electronic ballast with an unbalanced DC choke that causes the electronic ballast to produce the asymmetric lamp current.

7. The method of claim 6, wherein the step of replacing the DC choke includes the step of replacing the DC choke with a DC choke that includes first and second windings having unequal numbers of turns.

8. A method of creating an asymmetric current in a lamp connected to an electronic ballast including two inverter transistors, comprising the steps of:

causing the inverter transistors to have different conduction times using an unbalanced circuit component included in the inverter, the unbalanced circuit component having a DC choke that includes a pair of windings, each winding having a predetermined number of turns; and offsetting the number of turns in the pair of windings.

* * * * *